US007753009B2

(12) United States Patent
Quddus et al.

(10) Patent No.: US 7,753,009 B2
(45) Date of Patent: Jul. 13, 2010

(54) WASHER WITH BIO PREVENTION CYCLE

(75) Inventors: Mir A. Quddus, Raleigh, NC (US); Hamid Ghanei, Virginia Beach, VA (US); Imtiaz S. Shaha, Stevensville, MI (US); Anthony H. Hardaway, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 23 days.

(21) Appl. No.: 11/583,559

(22) Filed: Oct. 19, 2006

(65) Prior Publication Data

US 2008/0092602 A1 Apr. 24, 2008

(51) Int. Cl.
*A61L 2/07* (2006.01)

(52) U.S. Cl. ..... 122/4 R; 12/442; 60/908; 422/298; 422/27

(58) Field of Classification Search ..... 68/5 R; 422/27, 298, 299; 60/908; 8/137, 158, 159, 8/149; 510/276; 122/4 R, 442, 446, 447
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | J.J. Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |

(Continued)

FOREIGN PATENT DOCUMENTS

| | | | |
|---|---|---|---|
| CA | 1330526 | C | 7/1994 |

(Continued)

OTHER PUBLICATIONS

V-ZUG LTD Washing Machine Adora SL; User Manual; V-ZUG AG, CH-6301 Zug, 2004; V-ZUG LTD Industriestrasse 66, 6301 Zug, Tel. 041 767 67 67.

*Primary Examiner*—Gregory A Wilson
(74) *Attorney, Agent, or Firm*—Clifton G. Green; Greer, Burns & Crain Ltd

(57) ABSTRACT

An appliance having an enclosure arranged to receive articles to be treated also includes a water container and a steam chamber with a steam outlet. A water dispenser is arranged to dispense water from the water container to the steam chamber. A heating element is thermally associated with the steam chamber. A control is arranged to selectively operate the heating element. A steam path extends between the steam outlet and the enclosure. A chemical dispenser is positioned along the steam path. The heating element heats water in the steam chamber to create steam, and the chemical dispenser adds a chemical to the steam as the steam passes through the steam path.

19 Claims, 3 Drawing Sheets

U.S. PATENT DOCUMENTS

| | | | | |
|---|---|---|---|---|
| 2,966,052 | A | 12/1960 | Syles | |
| 3,035,145 | A | 5/1962 | Rudolph | |
| 3,060,713 | A | 10/1962 | Burkall | |
| 3,223,108 | A | 12/1965 | Martz, Jr | |
| 3,347,066 | A | 10/1967 | Klausner | |
| 3,550,170 | A | 12/1970 | Davis | |
| 3,712,089 | A | 1/1973 | Toth | |
| 3,801,077 | A | 4/1974 | Pearson | |
| 3,830,241 | A | 8/1974 | Dye et al. | |
| 3,869,815 | A | 3/1975 | Bullock | |
| 3,890,987 | A | 6/1975 | Marcussen et al. | |
| 3,935,719 | A | 2/1976 | Henderson | |
| 4,020,396 | A | 4/1977 | Gambale et al. | |
| 4,034,583 | A | 7/1977 | Miessler | |
| 4,045,174 | A | 8/1977 | Fuhring et al. | |
| 4,108,000 | A * | 8/1978 | Norris | 73/328 |
| 4,177,928 | A | 12/1979 | Bergkvist | |
| 4,207,683 | A * | 6/1980 | Horton | 34/60 |
| 4,214,148 | A | 7/1980 | Fleischhauer | |
| 4,263,258 | A * | 4/1981 | Kalasek | 422/113 |
| 4,332,047 | A | 6/1982 | Kuttelwesch | |
| 4,373,430 | A | 2/1983 | Allen | |
| 4,386,509 | A | 6/1983 | Kuttelwesch | |
| 4,432,111 | A | 2/1984 | Hoffmann et al. | |
| 4,489,574 | A | 12/1984 | Spendel | |
| 4,496,473 | A | 1/1985 | Sanderson | |
| 4,527,343 | A | 7/1985 | Danneberg | |
| 4,646,630 | A | 3/1987 | McCoy et al. | |
| 4,761,305 | A | 8/1988 | Ochiai | |
| 4,777,682 | A | 10/1988 | Dreher et al. | |
| 4,784,666 | A | 11/1988 | Brenner et al. | |
| 4,809,597 | A | 3/1989 | Lin | |
| 4,879,887 | A | 11/1989 | Kagi et al. | |
| 4,920,668 | A | 5/1990 | Henneberger et al. | |
| 4,987,627 | A | 1/1991 | Cur et al. | |
| 4,991,545 | A | 2/1991 | Rabe et al. | |
| 5,032,186 | A | 7/1991 | Childers et al. | |
| 5,050,259 | A | 9/1991 | Tsubaki et al. | |
| 5,052,344 | A | 10/1991 | Kosugi et al. | |
| 5,058,194 | A | 10/1991 | Violi | |
| 5,063,609 | A | 11/1991 | Lorimer | |
| 5,107,606 | A | 4/1992 | Tsubaki et al. | |
| 5,146,693 | A | 9/1992 | Dottor et al. | |
| 5,152,252 | A | 10/1992 | Bolton et al. | |
| 5,154,197 | A | 10/1992 | Auld et al. | |
| 5,172,654 | A | 12/1992 | Christiansen | |
| 5,172,888 | A | 12/1992 | Ezekoye | |
| 5,199,455 | A | 4/1993 | Dlouhy | |
| 5,212,969 | A | 5/1993 | Tsubaki et al. | |
| 5,219,370 | A | 6/1993 | Farrington et al. | |
| 5,219,371 | A | 6/1993 | Shim et al. | |
| 5,279,676 | A | 1/1994 | Oslin et al. | |
| 5,291,758 | A | 3/1994 | Lee | |
| 5,293,761 | A | 3/1994 | Jang | |
| 5,315,727 | A | 5/1994 | Lee | |
| 5,345,637 | A | 9/1994 | Pastryk et al. | |
| 5,570,626 | A | 11/1996 | Vos | |
| 5,619,983 | A | 4/1997 | Smith | |
| 5,727,402 | A | 3/1998 | Wada | |
| 5,732,664 | A | 3/1998 | Badeaux, Jr. | |
| 5,743,034 | A | 4/1998 | Debourg et al. | |
| 5,758,377 | A | 6/1998 | Cimetta et al. | |
| 5,768,730 | A | 6/1998 | Matsumoto et al. | |
| 5,815,637 | A | 9/1998 | Allen et al. | |
| 6,029,300 | A | 2/2000 | Kawaguchi et al. | |
| 6,067,403 | A | 5/2000 | Morgandi | |
| 6,094,523 | A | 7/2000 | Zelina et al. | |
| 6,122,849 | A * | 9/2000 | Kida et al. | 38/93 |
| 6,161,306 | A | 12/2000 | Clodic | |
| 6,178,671 | B1 | 1/2001 | Zwanenburg et al. | |
| 6,295,691 | B1 | 10/2001 | Chen | |
| 6,434,857 | B1 | 8/2002 | Anderson et al. | |
| 6,451,066 | B2 | 9/2002 | Estes et al. | |
| 6,585,781 | B1 | 7/2003 | Roseen | |
| 6,622,529 | B1 | 9/2003 | Crane | |
| 6,647,931 | B1 | 11/2003 | Morgandi et al. | |
| 6,691,536 | B2 | 2/2004 | Severns et al. | |
| 6,772,751 | B2 | 8/2004 | Deuringer et al. | |
| 6,789,404 | B2 | 9/2004 | Kim et al. | |
| 6,874,191 | B2 | 4/2005 | Kim et al. | |
| 6,889,399 | B2 | 5/2005 | Steiner et al. | |
| 7,021,087 | B2 | 4/2006 | France et al. | |
| 7,096,828 | B2 | 8/2006 | Tippmann | |
| 7,290,412 | B2 | 11/2007 | Yang et al. | |
| 7,325,330 | B2 | 2/2008 | Kim et al. | |
| 7,404,304 | B2 | 7/2008 | Yang et al. | |
| 7,421,752 | B2 | 9/2008 | Donadon et al. | |
| 7,490,491 | B2 | 2/2009 | Yang et al. | |
| 7,490,493 | B2 | 2/2009 | Kim et al. | |
| 7,520,146 | B2 | 4/2009 | Kim et al. | |
| 2001/0032599 | A1 | 10/2001 | Fischer et al. | |
| 2003/0215226 | A1 | 11/2003 | Nomura et al. | |
| 2003/0226999 | A1 | 12/2003 | Hage | |
| 2004/0163184 | A1 | 8/2004 | Waldron et al. | |
| 2004/0187527 | A1 | 9/2004 | Kim et al. | |
| 2004/0187529 | A1 | 9/2004 | Kim et al. | |
| 2004/0200093 | A1 | 10/2004 | Wunderlin et al. | |
| 2004/0206480 | A1 | 10/2004 | Maydanik et al. | |
| 2004/0221474 | A1 | 11/2004 | Slutsky et al. | |
| 2004/0237603 | A1 | 12/2004 | Kim et al. | |
| 2004/0244432 | A1 | 12/2004 | Kim et al. | |
| 2004/0244438 | A1 | 12/2004 | North | |
| 2004/0255391 | A1 * | 12/2004 | Kim et al. | 68/5 C |
| 2005/0000031 | A1 | 1/2005 | Price et al. | |
| 2005/0028297 | A1 * | 2/2005 | Kim et al. | 8/159 |
| 2005/0034248 | A1 | 2/2005 | Oh et al. | |
| 2005/0034249 | A1 | 2/2005 | Oh et al. | |
| 2005/0034250 | A1 | 2/2005 | Oh et al. | |
| 2005/0034487 | A1 | 2/2005 | Oh et al. | |
| 2005/0034488 | A1 | 2/2005 | Oh et al. | |
| 2005/0034489 | A1 | 2/2005 | Oh et al. | |
| 2005/0034490 | A1 | 2/2005 | Oh et al. | |
| 2005/0050644 | A1 | 3/2005 | Severns et al. | |
| 2005/0072382 | A1 | 4/2005 | Tippmann, Sr. | |
| 2005/0072383 | A1 | 4/2005 | Powell et al. | |
| 2005/0092035 | A1 | 5/2005 | Shin et al. | |
| 2005/0132503 | A1 | 6/2005 | Yang et al. | |
| 2005/0132504 | A1 | 6/2005 | Yang et al. | |
| 2005/0132756 | A1 | 6/2005 | Yang et al. | |
| 2005/0144734 | A1 | 7/2005 | Yang et al. | |
| 2005/0144735 | A1 | 7/2005 | Yang et al. | |
| 2005/0144737 | A1 | 7/2005 | Roepke et al. | |
| 2005/0205482 | A1 | 9/2005 | Gladney | |
| 2005/0220672 | A1 | 10/2005 | Takahashi et al. | |
| 2005/0223503 | A1 * | 10/2005 | Hong et al. | 8/158 |
| 2005/0223504 | A1 | 10/2005 | Lee et al. | |
| 2005/0252250 | A1 | 11/2005 | Oh et al. | |
| 2005/0262644 | A1 | 12/2005 | Oak et al. | |
| 2006/0000242 | A1 | 1/2006 | Yang et al. | |
| 2006/0001612 | A1 | 1/2006 | Kim | |
| 2006/0005581 | A1 | 1/2006 | Banba | |
| 2006/0010613 | A1 * | 1/2006 | Jeon et al. | 8/158 |
| 2006/0010727 | A1 | 1/2006 | Fung | |
| 2006/0010937 | A1 | 1/2006 | Kim et al. | |
| 2006/0016020 | A1 | 1/2006 | Park | |
| 2006/0090524 | A1 | 5/2006 | Jeon et al. | |
| 2006/0096333 | A1 | 5/2006 | Park et al. | |
| 2006/0101586 | A1 | 5/2006 | Park et al. | |
| 2006/0101588 | A1 | 5/2006 | Park et al. | |
| 2006/0101867 | A1 | 5/2006 | Kleker | |
| 2006/0107468 | A1 | 5/2006 | Urbanet et al. | |
| 2006/0112585 | A1 | 6/2006 | Choi et al. | |
| 2006/0117596 | A1 | 6/2006 | Kim et al. | |
| 2006/0130354 | A1 | 6/2006 | Choi et al. | |

| | | | |
|---|---|---|---|
| 2006/0137105 | A1 | 6/2006 | Hong et al. |
| 2006/0137107 | A1 | 6/2006 | Lee et al. |
| 2006/0150689 | A1 | 7/2006 | Kim et al. |
| 2006/0151005 | A1 | 7/2006 | Kim et al. |
| 2006/0151009 | A1 | 7/2006 | Kim et al. |
| 2006/0191077 | A1 | 8/2006 | Oh et al. |
| 2006/0191078 | A1 | 8/2006 | Kim et al. |
| 2006/0277690 | A1 | 12/2006 | Pyo et al. |
| 2007/0006484 | A1 | 1/2007 | Moschuetz et al. |
| 2007/0028398 | A1 | 2/2007 | Kwon et al. |
| 2007/0084000 | A1 | 4/2007 | Bernardino et al. |
| 2007/0101773 | A1 | 5/2007 | Park et al. |
| 2007/0107472 | A1 | 5/2007 | Kim et al. |
| 2007/0107884 | A1 | 5/2007 | Sirkar et al. |
| 2007/0125133 | A1 | 6/2007 | Oh et al. |
| 2007/0130697 | A1 | 6/2007 | Oh et al. |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1* | 1/2008 | Savage et al. ..... 422/27 |
| 2008/0028801 | A1 | 2/2008 | Czyzewski et al. |
| 2008/0115740 | A1 | 5/2008 | You |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | C | 3/1926 |
| DE | 435088 | C | 10/1926 |
| DE | 479594 | | 7/1929 |
| DE | 668963 | C | 12/1938 |
| DE | 853433 | C | 10/1952 |
| DE | 894685 | C | 10/1953 |
| DE | 1847016 | | 2/1962 |
| DE | 1873622 | | 6/1963 |
| DE | 2202345 | A1 | 8/1973 |
| DE | 2226373 | A1 | 12/1973 |
| DE | 2245532 | A1 | 3/1974 |
| DE | 7340082 | U | 5/1975 |
| DE | 2410107 | A1 | 9/1975 |
| DE | 2533759 | A1 | 2/1977 |
| DE | 3103529 | A1 | 8/1982 |
| DE | 3139466 | A1 | 4/1983 |
| DE | 3408136 | A1 | 9/1985 |
| DE | 3501008 | A1 | 7/1986 |
| DE | 3627988 | A1 | 4/1987 |
| DE | 8703344 | U1 | 8/1988 |
| DE | 4116673 | A1 | 11/1992 |
| DE | 4225847 | A1 | 2/1994 |
| DE | 4413213 | A1 | 10/1995 |
| DE | 4443338 | C1 | 6/1996 |
| DE | 29707168 | U1 | 6/1997 |
| DE | 29712586 | | 9/1998 |
| DE | 19730422 | A1 | 1/1999 |
| DE | 19736794 | A1 | 2/1999 |
| DE | 19742282 | | 2/1999 |
| DE | 19743508 | A1 | 4/1999 |
| DE | 19751028 | | 5/1999 |
| DE | 19903951 | A1 | 8/2000 |
| DE | 10028944 | A1 | 12/2001 |
| DE | 10035904 | A1 | 1/2002 |
| DE | 10039904 | A1 | 2/2002 |
| DE | 10043165 | A1 | 2/2002 |
| DE | 10312163 | A1 | 11/2003 |
| DE | 102005051721 | A1 | 5/2007 |
| DE | 102007023020 | B3 | 5/2008 |
| EP | 0043122 | A1 | 1/1982 |
| EP | 0132884 | A2 | 2/1985 |
| EP | 0135484 | | 3/1985 |
| EP | 0217981 | A1 | 4/1987 |
| EP | 0222264 | A2 | 5/1987 |
| EP | 0280782 | A1 | 9/1988 |
| EP | 0284554 | A1 | 9/1988 |
| EP | 0287990 | A2 | 10/1988 |
| EP | 0302125 | A1 | 2/1989 |
| EP | 363708 | | 4/1990 |
| EP | 0383327 | A1 | 8/1990 |
| EP | 0404253 | A1 | 12/1990 |
| EP | 0511525 | A1 | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | A2 | 4/1997 |
| EP | 0785303 | A1 | 7/1997 |
| EP | 0808936 | | 11/1997 |
| EP | 0816550 | A1 | 1/1998 |
| EP | 0821096 | A1 | 1/1998 |
| EP | 0839943 | A1 | 5/1998 |
| EP | 1163387 | A1 | 12/2001 |
| EP | 1275767 | | 1/2003 |
| EP | 1351016 | A2 | 10/2003 |
| EP | 1411163 | A2 | 4/2004 |
| EP | 1437547 | A2 | 7/2004 |
| EP | 1441059 | A1 | 7/2004 |
| EP | 1441175 | A2 | 7/2004 |
| EP | 1464750 | A1 | 10/2004 |
| EP | 1464751 | A1 | 10/2004 |
| EP | 1469120 | A1 | 10/2004 |
| EP | 1505193 | A2 | 2/2005 |
| EP | 1507028 | A1 | 2/2005 |
| EP | 1507029 | | 2/2005 |
| EP | 1507031 | | 2/2005 |
| EP | 1507032 | | 2/2005 |
| EP | 1507033 | A1 | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | A2 | 7/2005 |
| EP | 1555340 | A2 | 7/2005 |
| EP | 1561853 | A1 | 8/2005 |
| EP | 1584728 | A1 | 10/2005 |
| EP | 1619284 | A1 | 1/2006 |
| EP | 1507030 | | 2/2006 |
| EP | 1655408 | A1 | 5/2006 |
| EP | 1659205 | A2 | 5/2006 |
| EP | 1681384 | A1 | 7/2006 |
| EP | 1696066 | A2 | 8/2006 |

| | | | |
|---|---|---|---|
| EP | 1731840 | A1 | 12/2006 |
| EP | 1746197 | A2 | 1/2007 |
| EP | 1783262 | A2 | 5/2007 |
| EP | 1555339 | A2 | 8/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | A1 | 10/1976 |
| FR | 2525645 | A1 | 10/1983 |
| FR | 2581442 | | 11/1986 |
| FR | 2688807 | A1 | 9/1993 |
| GB | 21286 | | 8/1898 |
| GB | 10423 | | 11/1909 |
| GB | 21024 | | 2/1910 |
| GB | 191010567 | A | 4/1911 |
| GB | 191010792 | A | 4/1911 |
| GB | 191022943 | A | 9/1911 |
| GB | 191024005 | A | 10/1911 |
| GB | 191103554 | A | 12/1911 |
| GB | 102466 | A | 12/1916 |
| GB | 285384 | A | 11/1928 |
| GB | 397236 | A | 8/1933 |
| GB | 514440 | A | 11/1939 |
| GB | 685813 | A | 1/1953 |
| GB | 799788 | A | 8/1958 |
| GB | 835250 | A | 5/1960 |
| GB | 881083 | A | 11/1961 |
| GB | 889500 | A | 2/1962 |
| GB | 1155268 | A | 6/1969 |
| GB | 1331623 | A | 9/1973 |
| GB | 1352955 | A | 5/1974 |
| GB | 1366852 | A | 9/1974 |
| GB | 2219603 | A | 12/1989 |
| GB | 2309071 | A | 7/1997 |
| GB | 2348213 | A | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 5/1982 |
| JP | 57032858 | | 7/1982 |
| JP | 60138399 | A | 7/1985 |
| JP | 61128995 | A | 6/1986 |
| JP | 62066891 | A | 3/1987 |
| JP | 2049700 | A | 2/1990 |
| JP | 02161997 | A | 6/1990 |
| JP | 02026465 | | 7/1990 |
| JP | 02198595 | A | 8/1990 |
| JP | 2239894 | | 9/1990 |
| JP | 2242088 | A | 9/1990 |
| JP | 02267402 | A | 11/1990 |
| JP | 03025748 | | 6/1991 |
| JP | 3137401 | A | 6/1991 |
| JP | 4158896 | | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | A | 12/1993 |
| JP | 06123360 | A | 5/1994 |
| JP | 08261689 | A | 10/1996 |
| JP | 9133305 | A | 5/1997 |
| JP | 11047488 | A | 2/1999 |
| JP | 11164979 | A | 6/1999 |
| JP | 11164980 | A | 6/1999 |
| JP | 11226290 | | 8/1999 |
| JP | 2000176192 | A | 6/2000 |
| JP | 2003019382 | A | 1/2003 |
| JP | 2003093775 | A | 4/2003 |
| JP | 2003311068 | A | 11/2003 |
| JP | 2003311084 | A | 11/2003 |
| JP | 2003320324 | A | 11/2003 |
| JP | 2003326077 | A | 11/2003 |
| JP | 2004061011 | A | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | A | 5/2006 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 100146947 | | 10/1998 |
| KR | 200128631 | | 12/1998 |
| KR | 2019970039170 | | 12/1998 |
| KR | 20010015043 | | 2/2001 |
| KR | 1020010010111 | | 2/2001 |
| KR | 20040085509 | A | 10/2004 |
| KR | 20050017481 | A | 2/2005 |
| KR | 20060031165 | A | 4/2006 |
| WO | 9214954 | A1 | 9/1992 |
| WO | 9307798 | A1 | 4/1993 |
| WO | 9319237 | A1 | 9/1993 |
| WO | 9715709 | A1 | 5/1997 |
| WO | 0111134 | A1 | 2/2001 |
| WO | 0174129 | A2 | 10/2001 |
| WO | 03012185 | A2 | 2/2003 |
| WO | 03057966 | A2 | 7/2003 |
| WO | 2004059070 | A1 | 7/2004 |
| WO | 2004091359 | A2 | 10/2004 |
| WO | 2005/001189 | | 1/2005 |
| WO | 2005018837 | A1 | 3/2005 |
| WO | 2005115095 | A2 | 12/2005 |
| WO | 2006001612 | A1 | 1/2006 |
| WO | 2006009364 | A1 | 1/2006 |
| WO | 2006070317 | A | 7/2006 |
| WO | 2006/090973 | | 8/2006 |
| WO | 2006091054 | A1 | 8/2006 |
| WO | 2006091057 | A1 | 8/2006 |
| WO | 2006/101372 | A1 | 9/2006 |
| WO | 2006098571 | A1 | 9/2006 |
| WO | 2006098572 | A1 | 9/2006 |
| WO | 2006098573 | A1 | 9/2006 |
| WO | 2006101304 | A1 | 9/2006 |
| WO | 2006101312 | A1 | 9/2006 |
| WO | 2006101336 | A1 | 9/2006 |
| WO | 2006101345 | A1 | 9/2006 |
| WO | 2006101358 | A1 | 9/2006 |
| WO | 2006101360 | A1 | 9/2006 |
| WO | 2006101361 | A1 | 9/2006 |
| WO | 2006101362 | A1 | 9/2006 |
| WO | 2006101363 | A1 | 9/2006 |
| WO | 2006101365 | A1 | 9/2006 |
| WO | 2006101376 | A1 | 9/2006 |
| WO | 2006101377 | A1 | 9/2006 |
| WO | 2006104310 | A1 | 10/2006 |
| WO | 2006112611 | A1 | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |

| | | | |
|---|---|---|---|
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007/055475 | | 5/2007 |
| WO | 2007055510 | A1 | 5/2007 |
| WO | 2007058477 | A1 | 5/2007 |
| WO | 2007/073012 | | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008/004801 | | 1/2008 |

* cited by examiner

WASHER WITH BIO PREVENTION CYCLE

BACKGROUND OF THE INVENTION

The present invention relates to a method and apparatus for providing a bio prevention cycle for an automatic clothes washer, and more particularly to methods and systems for preventing the build-up of microorganisms or other materials in an automatic clothes washer or similar appliances.

Under normal usage of an automatic clothes washer, detergent residues build up with minerals and soils, which harden on the washer, often in areas that the consumer cannot see. This is particularly true when a consumer uses a higher sudsing detergent. These soils then form an excellent medium for supporting and growing bacteria, fungi, and other microorganisms. Consumers rarely see such microorganisms, but the washer will eventually release or have a foul odor due to these microorganisms.

It would therefore be an improvement in the art if there was provided a method or system for killing the microorganisms which are existing in an automatic clothes washer.

SUMMARY OF THE INVENTION

The present invention provides an improvement in the art by providing methods and systems for an automatic washer which will kill microorganisms that are present in the washer.

In an embodiment of the invention, an appliance having an enclosure arranged to receive articles to be treated also includes a water container and a steam chamber with a steam outlet. A water dispenser is arranged to dispense water from the water container to the steam chamber. A heating element is thermally associated with the steam chamber. A control is arranged to selectively operate the heating element. A steam path extends between the steam outlet and the enclosure. A chemical dispenser is positioned along the steam path. The heating element heats water in the steam chamber to create steam, and the chemical dispenser adds a chemical to the steam as the steam passes through the steam path.

DETAILED DESCRIPTION OF THE PREFERRED EMBODIMENT

The present invention is useful in many different types of appliances having a washing or cleaning cycle, such as clothes washers, dish washers, clothes refreshers, dry cleaning appliances, etc., in which various types of articles are to be treated. For the purposes of disclosing an embodiment of the invention, the environment of a clothes washer is used, although the invention is not limited to such an appliance, or to the particular type of clothes washer illustrated.

Figure 1:
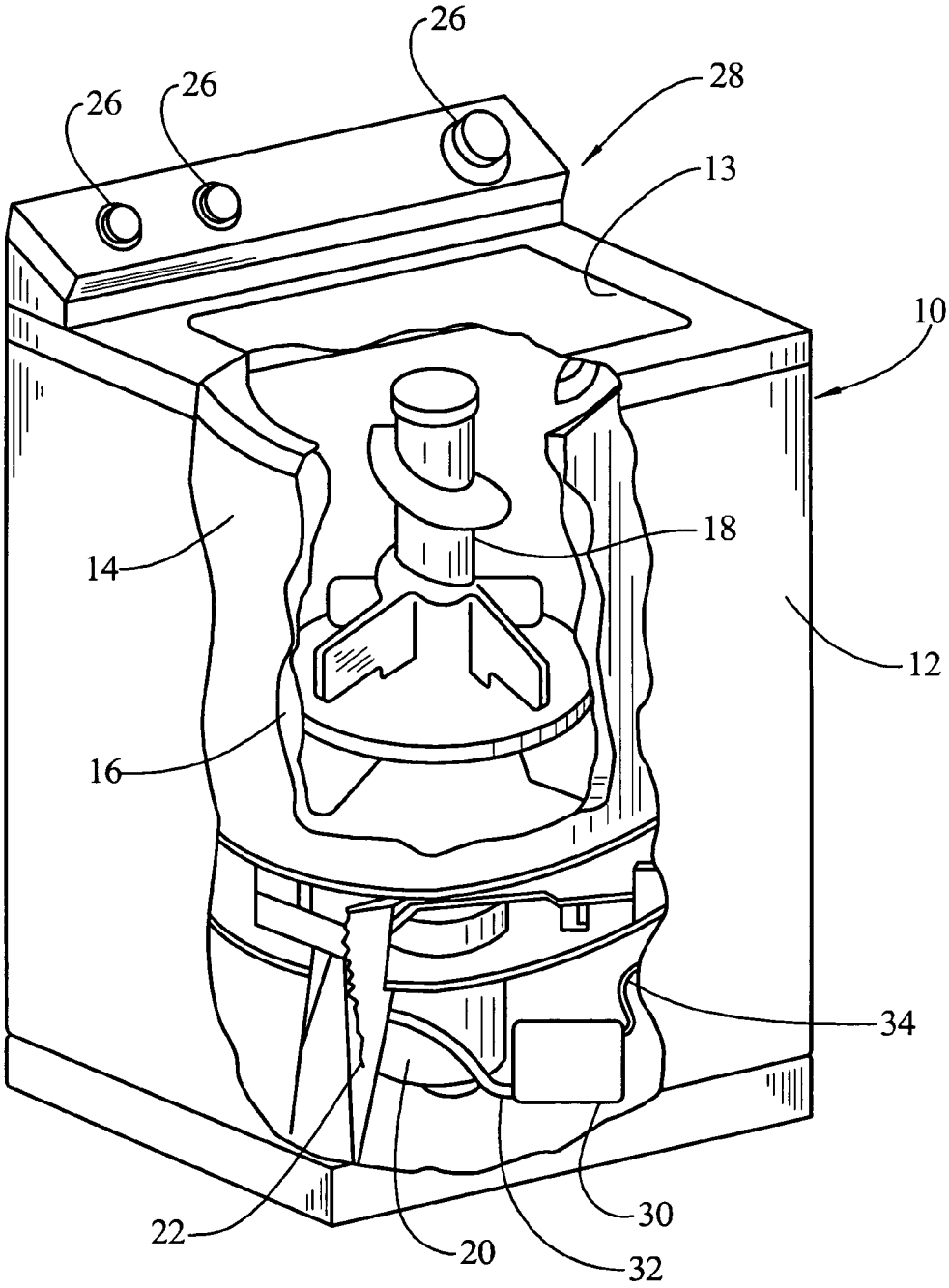
FIG. 1 is a perspective view of an automatic washer embodying the principles of the present invention.

In FIG. 1 there is illustrated an appliance in the form of an automatic washer generally at 10 embodying the principles of the present invention. The washer has an outer cabinet 12 with an openable lid 13 which encloses an imperforate wash tub 14 for receiving a supply of wash liquid. Concentrically mounted within the wash tub is a wash basket 16 for receiving a load of materials to be washed and a vertical axis agitator 18. A motor 20 is provided which is drivingly connected to the agitator 18 to rotatingly drive it in an oscillatory or rotary manner, and is also selectively connectable to the basket 16 for simultaneous rotation with the agitator 18. The assembly of the tub 14, wash basket 16, agitator 18, and motor 20 is mounted on a suspension system 22. A plurality of controls 26 are provided on a control console 28 for automatically operating the washer through a series of washing, rinsing, and liquid extracting steps.

The washer also includes a disinfecting unit 30, which may be connected to an external water supply via a conduit 32 and to the wash tub 14, or elsewhere in the enclosure formed by the outer cabinet 12, via a conduit 34. The location for the disinfecting unit 30 is only schematically illustrated, and it could actually be located in a variety of different locations in the cabinet 12, where space permits, or even remote from the cabinet, such as in an adjacent cabinet or appliance. The invention can also be used with clothes washers that do not include a vertical agitator, such as those that agitate by other mechanisms, such as nutating plates, baffles on the basket, etc., as well as horizontal axis washers which provide agitation via tumbling. Other washing or cleaning appliances do not agitate the materials being washed or cleaned, but rather provide sprays or mists of water or other cleaning, washing, refreshing and rinsing fluids.

Figure 2:
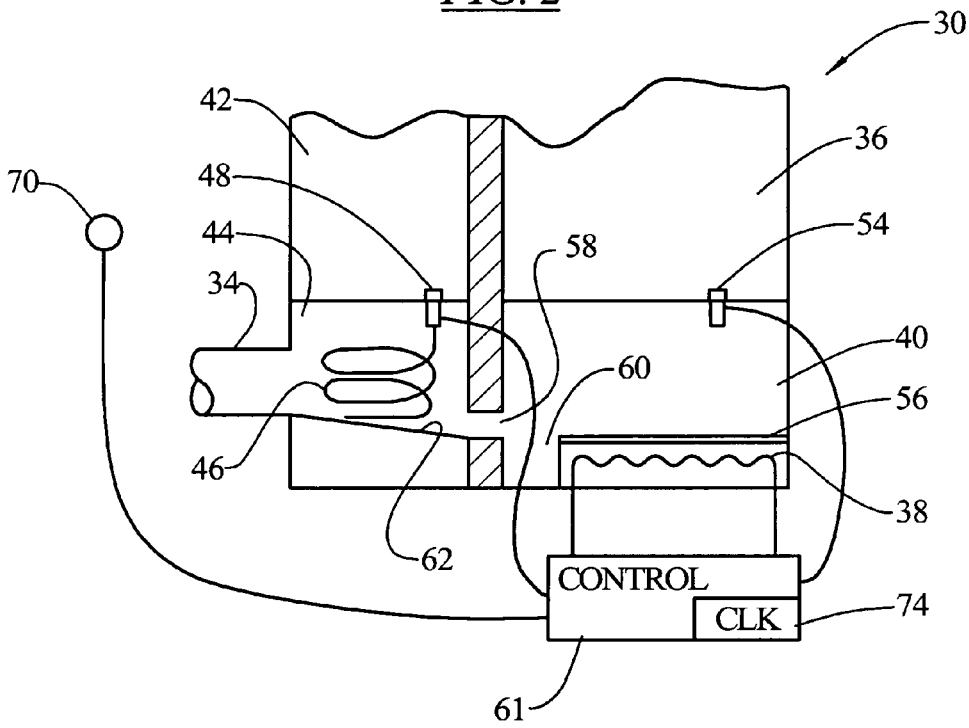
FIG. 2 is a schematic partial view of the interior of one embodiment of the disinfecting unit of the automatic washer of FIG. 1, consistent with methods and systems embodying the principles of the present invention.

FIG. 2 provides the details of the disinfecting unit 30. The disinfecting unit 30 includes a water container 36, a heating element 38, a steam chamber 40, a chemical or biocide container 42, and a mixing chamber 44. The mixing chamber 44 includes a projection which may be in the form of a wire 46 attached to a chemical dispenser 48. The chemical dispenser 48 may be electrically or mechanically controlled, although a control is not necessary in all embodiments. The water container 36 may be automatically filled via the conduit 32 from an external water supply, such as that used to supply water to other parts of the washer 10.

Figure 3:
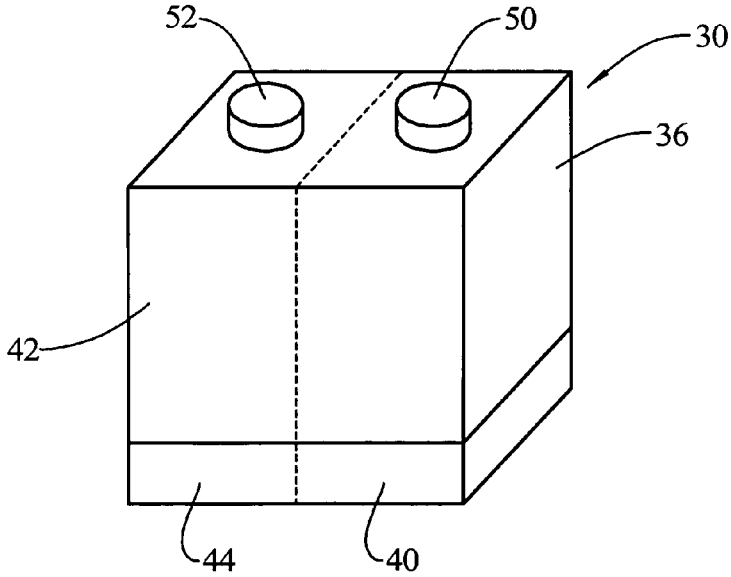
FIG. 3 is a perspective view of one embodiment of the exterior of the disinfecting unit.

In other embodiments, the water container 36 may include an openable cap 50 (FIG. 3) and the user of the washer may refill the water container manually. The chemical container 42 may also include an openable cap 52 to permit refilling of the chemical. In some embodiments, the chemical container may contain a long term supply, such as a supply that should last for 10 years under normal usage. The chemical container 42 might be a cartridge that is removable and replaceable, with a fresh supply of chemical, separately from the remainder of the disinfecting unit 30. In still other embodiments, the entire disinfecting unit 30 is removable and replaceable with a fresh unit, so that no refilling is necessary, or so that accessibility for refilling is improved.

The water container 36 includes a water dispenser 54, which also may be electrically or mechanically controlled, to cause drops of water to be dispensed into the steam chamber 40, preferably located below the water container. The heating element 38 is thermally associated with a portion of the steam chamber 40 to heat the water drops that have entered the steam chamber. Although depicted as being at the bottom of the steam chamber 40, one skilled in the art will recognize that the heating element 38 could be associated with the steam chamber in a number of configurations. For example, the heating element 38 could surround the steam chamber 40, or it could be located in the center of the chamber. When the heating element 38 is located at the bottom of the steam chamber 40, the water drops from the water container 36 will fall on a surface 56 heated by the heating element, and will quickly be converted to steam.

A passageway 58 allows steam to flow along a path from the steam chamber 40 to the mixing chamber 44. The chemical dispenser 48 allows chemical drops from within the chemical container 42 to flow along the wire 46 into the mixing chamber 44. These drops will coat a large surface area of the wire 46, allowing for quick and efficient absorption or adsorption of the chemical by the steam in the mixing chamber 44. One skilled in the art will recognize that other configurations or arrangements to dispense the chemical into the mixing chamber 46 can be used. For example, the chemical could be a solid that dissolves upon contact with the steam, or the chemical could automatically travel down the wire without the dispenser, like a wick.

A wide variety of chemicals may be used with the invention, including various pesticides, for example, common EPA registered antimicrobials, such as the full list of "MICROBAN" products. Also, hydrogen peroxide and its variations, silver, copper or zinc ions, chlorine bleach, and in some instances, simply steam.

The steam chamber 40 may have a collection sump 60 for receiving any condensate from the steam that has not exited the steam chamber. The mixing chamber 44 may have a bottom wall or floor 62 which is sloped downwardly towards the passageway 58, also to allow condensate, or excess chemical liquid, to flow into the collection sump 60 in the steam chamber 40. If the disinfecting unit 30 is permanent or refillable, the sump may have an openable drain to allow removal of collected liquids from time to time. Alternatively, a liquid moving mechanism, such as a pump or piston, could be used to redirect the condensate back to the surface 56 heated by the heating element 38 to assure that all of the chemical and water is dispensed with the steam.

Figure 4:
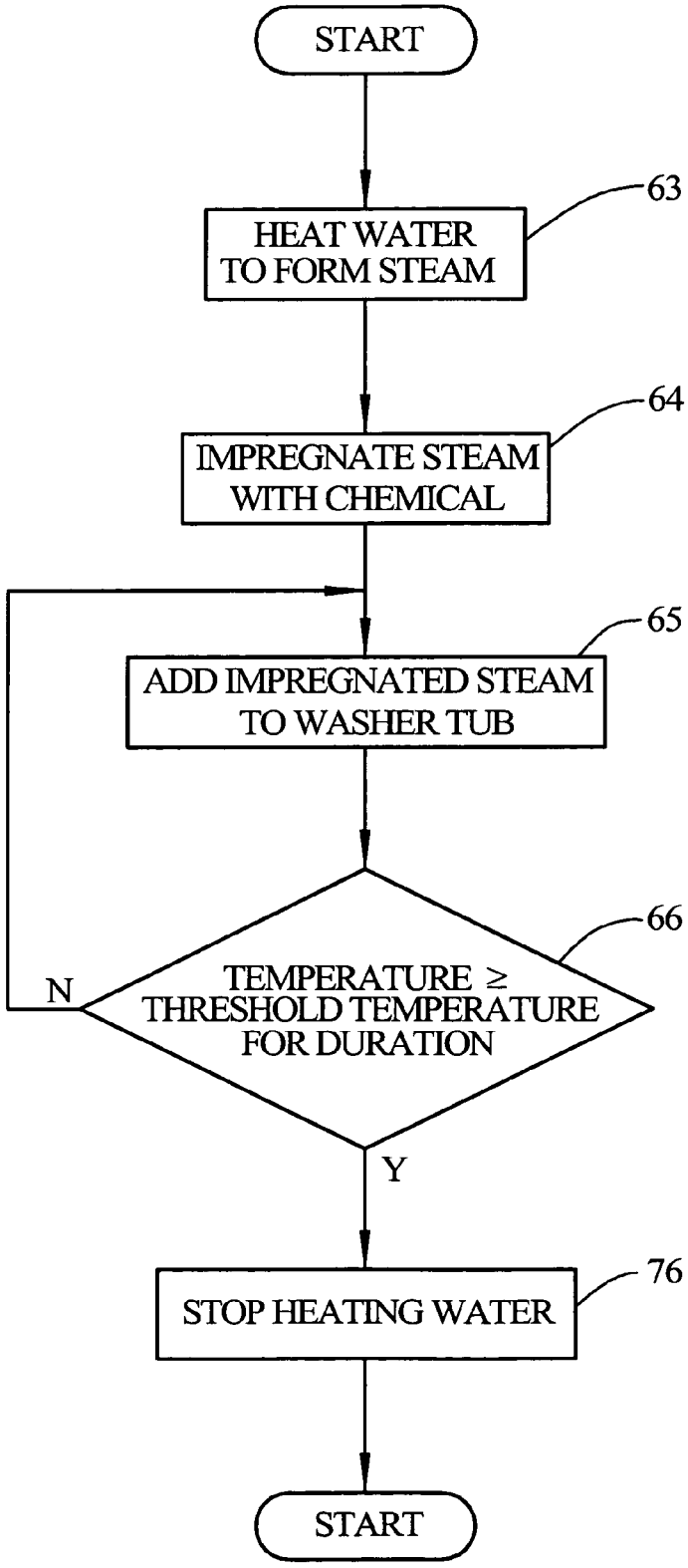
FIG. 4 is a flow diagram of the steps performed by the disinfecting unit.

In operation, when a disinfecting cycle is initiated, the water dispenser 54, operated by a control 61, permits drops of water to leave the water container 36 and fall into the steam chamber 40. The heating element 38, also operated by the control 61, heats the water in the steam chamber 40 until steam is formed (step 63, FIG. 4). The steam exits through the passageway 58 to enter mixing chamber 44. The chemical dispenser 48 controllably allows chemical drops to enter the mixing chamber 44 via the wire 46. The chemical drops are absorbed or adsorbed (depending on the solubility of the chemical in water) by the steam in the mixing chamber 44, so that the steam becomes impregnated with the chemical (step 64). The impregnated steam enters the wash tub 14 through the conduit 34 (step 65).

The heating element 38 continues to heat the water until the temperature in the wash tub 14 reaches a threshold temperature for a given duration (step 66). Temperature sensors 70 provided at appropriate locations within the appliance, which communicate with the control 61, measure the temperature in the region of the wash tub. The threshold temperature may be 65° C., 70° C., 75° C. or higher for durations of 5 minutes, 10 minutes, 15 minutes, or longer to kill the microorganisms. Preferably, the temperature will be elevated to 67-70° C. for 10 minutes, as determined by a clock 74 in the control 61. With increased temperatures, the duration may be shortened and with decreased temperatures, the duration may be increased. After the threshold temperature is reached for the given duration, the control 61 terminates operation of the heating element 38 to stop the heating of the water (step 76) and terminates the dispensing of water and chemical. For some chemicals, such as silver, copper or zinc ions, would allow for ambient temperatures to be used, rather than elevated temperatures for some given period of time.

The steam impregnated with the chemical is used to thermally and/or chemically kill any microorganisms that exist in the appliance, or to provide other chemical treatment in the appliance, such as scale removal. The steam is able to transport the chemical to areas that are not typically reachable by other means, e.g., by rinsing the washer tub or basket with chemically treated water. In a washer environment, the present invention allows for treatment of the inside and outside of the basket, the tub, the sump, and all of the hoses.

The bio prevention (or other chemical treatment) cycle can be performed as an automatic cycle by the control operating the washer 10, such as at the end of each complete wash cycle. Alternatively, or in addition, the bio prevention cycle could be initiated by the user via a manual selection on a control panel of the washer.

The use of the present invention could also provide for reduced water usage in a wash cycle. The water usage savings could come from the utilization of steam as the vehicle to deliver heat to the wash load, rather than a deep water fill. Less energy would be required to heat a smaller volume of water into steam for the heating, in addition to using less water in the wash cycle.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. An appliance comprising:

an enclosure arranged to receive articles to be treated;

a water container, a steam chamber having a steam outlet, a water dispenser arranged to dispense water from the water container to the steam chamber;

a heating element thermally associated with the steam chamber;

a control arranged to selectively operate the heating element;

a steam path between the steam outlet and the enclosure;

a chemical dispenser positioned along the steam path;

wherein the heating element heats water in the steam chamber to create steam, and the chemical dispenser adds a chemical to the steam as the steam passes through the steam path.

2. The appliance of claim 1, wherein the water dispenser is electrically controlled.

3. The appliance of claim 1, wherein the steam chamber is located below the water container and the heating element is located in a floor of the steam chamber.

4. The appliance of claim 1, wherein the steam path comprises a mixing chamber which communicates with the chemical dispenser.

5. The appliance of claim 4, including a projection extending from the chemical dispenser into the mixing chamber.

6. The appliance of claim 4, wherein the steam path comprises a conduit leading from the mixing chamber to the enclosure.

7. The appliance of claim 1, further including a chemical container communicating with the chemical dispenser.

8. The appliance according to claim 7, wherein the water container, the chemical container, the steam chamber and the mixing chamber comprise a removable and replaceable unit.

9. The appliance according to claim 7, wherein the chemical container includes a removable cap to permit refilling of the chemical container.

10. The appliance according to claim 1, including a water conduit leading to the water container to provide a supply of water to the container from an outside source.

11. The appliance according to claim 1, including a temperature sensor associated with the enclosure to provide a temperature signal to the control.

12. The appliance according to claim 1, including a clock associated with the control.

13. An automatic washer comprising:

a wash tub arranged to receive articles to be treated;

a water container;

a steam chamber located below the water container and having a steam outlet, a water dispenser arranged to dispense water from the water container to the steam chamber;

a heating element located in a floor of the steam chamber;

a control arranged to selectively operate the heating element;

a chemical container;

a mixing chamber located below the chemical container, communicating with the steam outlet of the steam chamber and forming a portion of a steam path between the steam outlet and the wash tub;

a chemical dispenser arranged to dispense chemical from the chemical container to the mixing chamber;

wherein the heating element heats water in the steam chamber to create steam, and the chemical dispenser adds a chemical to the steam as the steam passes through the steam path.

14. The automatic washer of claim 13, including a wire extending from the chemical dispenser into the mixing chamber.

15. The automatic washer of claim 13, wherein the water container, the chemical container, the steam chamber and the mixing chamber comprise a removable and replaceable unit.

16. The automatic washer of claim 13, wherein the chemical container includes a removable cap to permit refilling of the chemical container.

17. The automatic washer of claim 13, including a temperature sensor associated with the wash tub to provide a temperature signal to the control.

18. The automatic washer of claim 13, including a clock associated with the control.

19. A method of killing microorganisms in an appliance having an enclosure arranged to receive articles to be treated comprising:

generating a flow of steam by controllably dripping drops of water from a water container onto a surface heated by a heating element, adding a chemical to the flow of steam by controllably dispensing drops along a projection which is located in the flow of steam, and directing the flow of steam with the added chemical into the enclosure by confining the flow of steam in a conduit leading from an area where the chemical is added to the flow of steam to the enclosure.

* * * * *